US006005521A

United States Patent [19]

Suguro et al.

[11] Patent Number: 6,005,521

[45] Date of Patent: Dec. 21, 1999

[54] COMPOSITE ANTENNA

[75] Inventors: Akihiro Suguro; Hideto Ookita, both of Kanagawa, Japan

[73] Assignee: Kyocera Corporation, Kyoto, Japan

[21] Appl. No.: 09/068,130

[22] PCT Filed: Apr. 23, 1997

[86] PCT No.: PCT/JP97/01402

§ 371 Date: Apr. 30, 1998

§ 102(e) Date: Apr. 30, 1998

[87] PCT Pub. No.: WO97/40548

PCT Pub. Date: Oct. 30, 1997

[30] Foreign Application Priority Data

Apr. 25, 1996 [JP] Japan ..... 8-105509
Jul. 25, 1996 [JP] Japan ..... 8-196038

[51] Int. Cl.[6] ..... H01Q 1/38; H01Q 1/36

[52] U.S. Cl. ..... 343/700 MS; 343/702; 343/725; 343/895

[58] Field of Search ..... 343/725, 726, 343/727, 728, 700 MS, 895

[56] References Cited

U.S. PATENT DOCUMENTS 5,313,216 5/1994 Wang et al. ..... 343/700 MS
5,353,035 10/1994 Del Castillo Cuervo-Arango et al. ..... 343/700 MS

FOREIGN PATENT DOCUMENTS 2224506 9/1990 Japan .
5299925 11/1993 Japan .
6164232 6/1994 Japan .
54526 7/1994 Japan .
7022829 1/1995 Japan .
7183719 7/1995 Japan .
9098018 4/1997 Japan .

*Primary Examiner*—Don Wong
*Assistant Examiner*—Tan Ho
*Attorney, Agent, or Firm*—Loeb & Loeb, LLP

[57] ABSTRACT

A microstrip plane antenna and a helical antenna are arranged substantially in line therewith. A base conductor of the microstrip plane antenna is electrically coupled with the helical antenna, thereby allowing stable communications with a orbiting communications satellite in the sky.

5 Claims, 11 Drawing Sheets

COMPOSITE ANTENNA

FIELD OF THE INVENTION

The present invention relates to a circularly polarized antenna which possesses directivity ranging from a low elevation angle to the zenith and is suitable for use in communications with a low or intermediate orbiting satellite, and to an antenna which has the advantage of becoming more compact and of being mounted on a portable telephone for use with a communications satellite or on a compact portable radio.

BACKGROUND OF THE INVENTION

The concept of a portable telephone which uses a low or intermediate orbiting satellite as a communications satellite, has recently been proposed by various corporations. As the frequency bands for use in such communications, a frequency band of 1.6 GHz is assigned to communications from a ground portable telephone to a communications satellite, and a frequency band of 2.4 GHz is assigned to communications from the communications satellite to the ground portable telephone. The frequency band of 1.6 GHz is also assigned to a frequency band for use in bidirectional communications between ground stations and the communications satellite. A circularly polarized wave is commonly used in the communications in order to ensure the quality of a communications circuit.

An antenna has already been proposed as means for improving the quality of the communications circuit (as disclosed in Unexamined Japanese Patent Application No. Hei-7-183719). Specifically, a base conductor extends from a plane antenna in the direction opposite to an antenna element in order to improve the directivity of the antenna at a low elevation angle. FIG. 10 illustrates an example of a conventional antenna. In order to improve the directivity of the antenna at a low elevation angle, a microstrip plane antenna (MSA) 1 is comprised of a dielectric substrate 1*c*, a patched radiating element 1*b* provided on the dielectric substrate 1*c*, a ground conductor 1*d* attached to the bottom of the radiating element 1*b*, and a cylindrical ground conductor 1*e* downwardly extending from the base conductor 1*d*.

In a case where the conventional antenna receives an incoming circularly polarized wave from a satellite or sends the circularly polarized wave from a ground station to the satellite at a low elevation angle, the gain of the antenna and the axial ratio of the circularly polarized wave become too large, which in turn affects the quality of the communications circuit that is liable to variations in the positional relationship between the antenna of portable communications equipment and the antenna of the satellite. Thus, it has been difficult to maintain the sensitivity of communication of the antenna in every direction of the sky.

The present invention has been conceived in view of the aforementioned drawback in the art, and the object of which is to particularly improve the directivity and axial ratio of an antenna having a circularly polarized wave mode at a low elevation angle.

According to the present invention, the above-described object is accomplished by the structure disclosed in appended claims of the specification. More specifically, the present invention provides a composite antenna comprising:

a microstrip plane antenna (MSA) which possesses a circularly polarized wave mode and is made up of a conductive plate serving as a common base conductor, a dielectric layer provided on the conductor plate, and a patched radiating element provided parallel to the conductor plate with the dielectric layer between them;

a linear radiating element which is helically wrapped in a substantially coaxial relationship with respect to the microstrip plane antenna and is provided below the conductor plate; and the upper ends of the helically coiled linear radiating element being electrically connected to the conductor plate, thereby forming a helical antenna. The helical antenna may be connected to the conductor plate by DC or capacitive coupling.

The directivity of a radiation pattern at a high elevation angle greatly depends on a plane portion of the patched radiating element of the MSA. In contrast, the directivity of the radiation pattern at a low elevation angle greatly depends on the helical antenna and the electric field developed between the periphery of the patched radiating element of the MSA and the base conductor.

If the base conductor of the MSA is downwardly extended as are the base conductor of the conventional antenna, the antenna has a high sensitivity with regard to a polarized wave in the axial direction of the antenna (i.e., a vertically polarized wave) but a low sensitivity with regard to a horizontally polarized wave.

According to the present invention, the sensitivity of the antenna with regard to the horizontally polarized wave is improved by electrically coupling the helical antenna to the conductor of the MSA in the way as previously described. The helical antenna contributes to improvements in the sensitivity of the antenna with regard to the horizontally polarized wave, due to horizontal components made of high frequency currents which flow through the helical antenna. The line width, length, the number of turns of the helical element, and the pitch with which the helical element is coiled, may be designed according to a satellite communications system as required.

BRIEF DESCRIPTION OF THE DRAWINGS

FIGS. 4A and 4B provide examples of measurement of the gain of the composite antenna of the present invention with regard to the linearly polarized wave while the direction of the zenith of the composite antenna is set to 90 degrees, wherein FIG. 4A is a radiation pattern diagram obtained when a longer side of a patched radiating element is brought in parallel to the direction of the electric field of the linearly polarized antenna (i.e., a transmission antenna), and FIG. 4B is a radiation pattern diagram obtained when the longer side of the patched radiating element is brought in parallel to the direction of the magnetic field of the linearly polarized antenna (i.e., the transmission antenna;

FIGS. 5A and 5B provide examples of the gain of the composite antenna of the present invention with regard to the linearly polarized wave measured in the same way as in the case illustrated in FIGS. 4A and 4B, while the axis of the composite antenna is further rotated through 90 degrees from the state provided in FIGS. 4A and 4B, wherein FIG. 5A is a radiation pattern diagram obtained when a shorter side of the patched radiating element is brought in parallel to the direction of the electric field of the linearly polarized antenna, and FIG. 5B is a radiation pattern diagram obtained when the shorter side of the patched radiating element is brought in parallel to the direction of the magnetic field of the linearly polarized antenna;

DETAILED DESCRIPTION OF THE PREFERRED EMBODIMENT

As an embodiment, the present invention provides a composite antenna comprising:

a microstrip plane antenna including a conductive plate serving as a common base conductor, a dielectric layer provided on the conductor plate, a patched radiating element provided parallel to the conductor plate with the dielectric layer between them, a feeding pin for feeding power to the patched radiating element which has a feeding point in the vicinity of a through-hole formed in the conductor plate and upwardly extends from the feeding point;

a linear radiating element which is helically wrapped in a substantially coaxial relationship with respect to the microstrip plane antenna and is provided below the conductor plate; and the upper ends of the helically coiled linear radiating element being connected to the conductor plate by DC or capacitive coupling, thereby forming a helical antenna which shares the feeding point with the microstrip plane antenna.

Figure 1A:
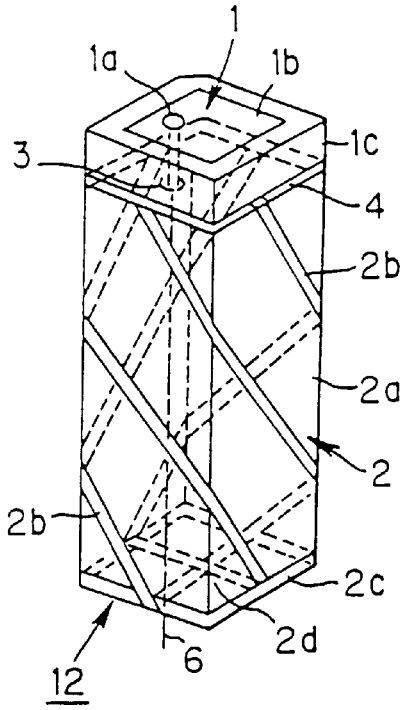
FIG. 1A illustrates a composite antenna according an embodiment of the present invention, having a square MSA and a four-wire helical antenna arranged substantially in a coaxial manner with respect thereto.
Figure 1B:
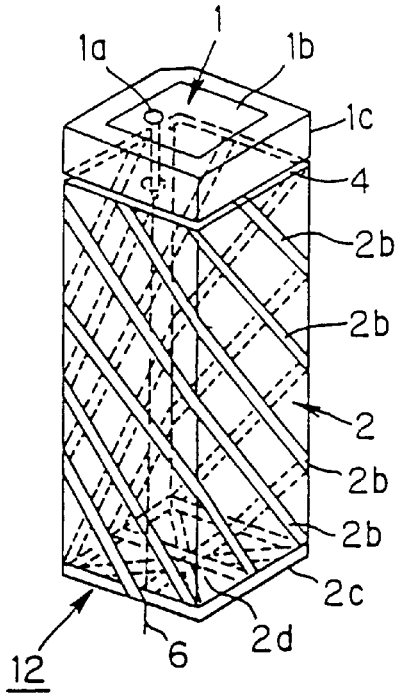
FIG. 1B illustrates a composite antenna according to an embodiment of the present invention, having a square MSA and an eight-wire helical antenna arranged substantially in a coaxial manner with respect thereto.

FIGS. 1A and 1B illustrate examples of a square-rod-shaped antenna according to the embodiment of the present invention. FIG. 1A illustrates an example of the antenna having a four-wire helical antenna coupled thereto, and FIG. 1B illustrates an example of the antenna having an eight-wire helical antenna coupled thereto. In the drawings, the same elements are assigned the same reference numerals. Reference numeral 1 designates a microstrip plane antenna (hereinafter referred to as an MSA); 2 designates a helical antenna; 3 designates a feeding point shared between the MSA 1 and the helical antenna 2; 4 designates a base conductor of the MSA 1 and a plane base conductor (a conductor plate) for supplying power to the helical antenna 2; and 12 designates a composite antenna formed from the MSA 1 and the helical antenna 2.

More specifically, reference numeral 1*a* designates a feeding pin of the MSA 1; 1*b* designates a patched radiating element of the MSA 1; and 1*c* designates a dielectric substrate of the MSA 1. Reference numeral 2*a* designates a dielectric pole supporting the helical antenna; 2*b* designates a linear radiating element of the helical antenna; 2*c* designates insulating material for preventing the radiating elements from coming into contact with one another at intersections formed at the lower end of the helical antenna; and 2*d* designates an intersection between the radiating elements formed at the lower end of the helical antenna.

Figure 2A:
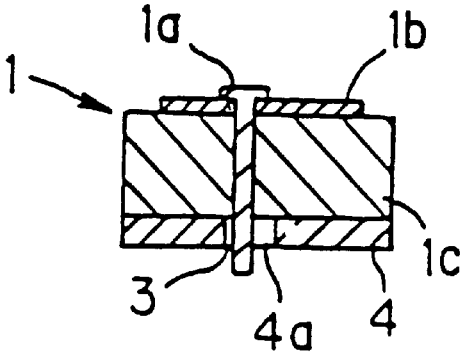
FIG. 2A is a cross-sectional view of the MSA taken across line A—A.
Figure 2B:
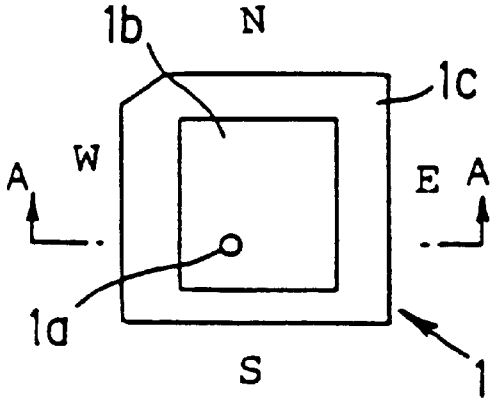
FIG. 2B is a top view of the MSA.

First, the MSA 1 designates a one-point back feeding plane antenna. FIG. 2A is a cross-sectional view of the square one-point back feeding MSA 1; and FIG. 2B is a top view of the MSA 1. A through-hole 4*a* is formed in the conductor plate 4 which is the base conductor, and power is fed to the patched radiating element 1*b* from its back via the feeding pin 1*a*. In addition to the square MSA, circular, triangular, and pentagonal MSAs are also known. In the case of the antenna of the present embodiment having the square patched radiating element 1*b*, a desired frequency which operates in the form of a circularly polarized wave is obtained by controlling the lengths of the longitudinal and lateral sides of the square MSA, and the dielectric constant and thickness of the dielectric substrate 1*c*. The frequency of the antenna varies from several to tens of megahertz according to the width and size of the helical antenna 2. Therefore, it is necessary to previously take into consideration these variations.

As illustrated in FIGS. 1A and 1B, so long as the outside shape (i.e., the cross-sectional profile and it's dimension) of the helical antenna 2 is brought in substantially accord with that of the MSA 1, essentially uniform directivity is obtained in substantially every direction from a low elevation angle to the zenith. In contrast, if the outside shape of the helical antenna 2 is made larger than that of the MSA 1, the directivity of the antenna in the direction of a low elevation angle is reduced, whereas the directivity toward the zenith is increased. Conversely, if the outside shape of the helical antenna 2 is made smaller than that of the MSA 1, sufficient directivity of the antenna in the direction of the low elevation angle is not obtained.

In general, it is known that a receiving power falls about 3 dB if a linearly polarized antenna receives a circularly polarized wave. For this reason, there arises a loss of 3 dB if a vertically polarized antenna receives the electric wave emanated from a circularly polarized antenna of a low-elevation-angle communications satellite. As is evident from Table 1, the composite antenna of the present invention allows stable communications because the gain of the antenna with regard to the horizontally polarized component is particularly improved.

Figure 3A:
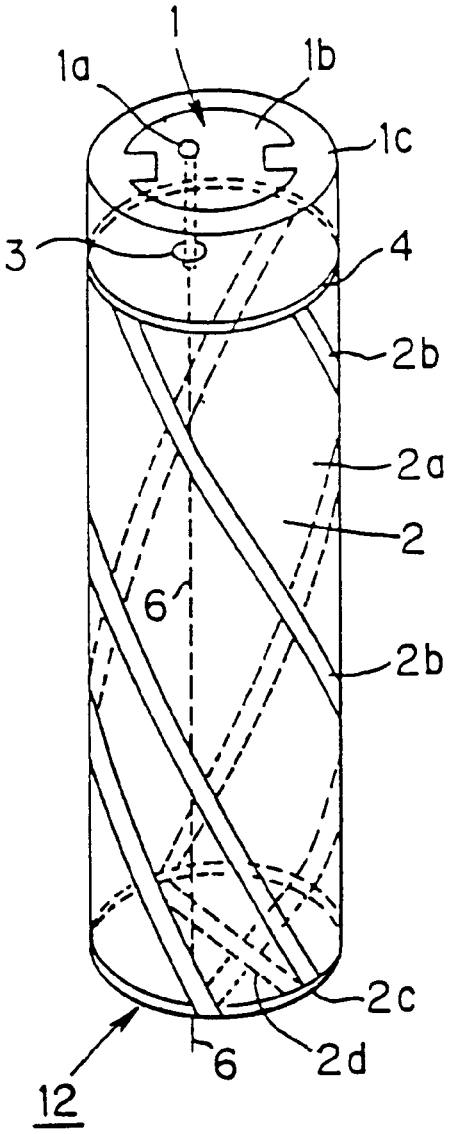
FIG. 3A illustrates a composite antenna according to another embodiment of the present invention, having a circular MSA and a four-wire helical antenna arranged substantially in a coaxial manner with respect thereto.
Figure 3B:
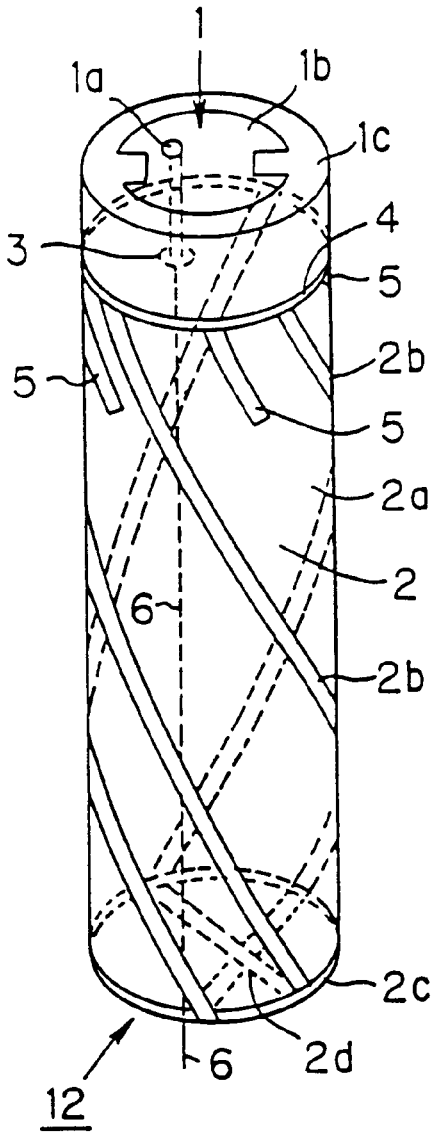
FIG. 3B illustrates a composite antenna according to another embodiment of the present invention, having a radiating element for controlling the directivity of the antenna provided thereon.

Although the composite antenna is formed into a square rod by use of the square MSA 1 in the previous embodiment, it may be formed into a circular rod by use of a circular MSA 1 as illustrated in FIG. 3A or may be formed into a triangular pole. The composite antenna of the present invention is not limited to any particular shapes. The shape of the composite antenna may be selected according to the design or applications of a portable radio on which the composite antenna of the present invention is mounted. As illustrated in FIG. 3B, another linear radiating element 5 may be wrapped around the dielectric pole 2*a* for adjusting the directivity of the composite antenna, in addition to the linear radiating elements 2*b* coiled around the dielectric pole 2*a* so as to form the helical four-wire antenna. In this case, the linear radiating elements 5 and the linear radiating elements 2*b* forming the four-wire helical antenna are alternately positioned. The linear radiating elements 5 are at one end connected to the base conductor 4, as are the linear radiating elements 2*b*, but are open at the other end.

Although the previous embodiment provides an example in which the linear radiating elements 2*b* of the helical antenna 2 and the linear radiating elements 5 are directly connected to the edge of the base conductor 4 by DC coupling, they may be coupled to the edge of the base conductor 4 without a direction contact between them by capacitive coupling.

Table 1 provides measurement results with regard to the composite antenna of the embodiment of the present invention and to the conventional antenna having the base conductor of the MSA downwardly extended. In this example, the composite antenna of the present invention and the conventional antenna used identical square MSAs. A square rod which is made of thick paper so as to have substantially the same outer dimension as that of the MSA, was used as the dielectric material for supporting the MSA. With regard to the composite antenna according to the embodiment of the present invention, the four helical radiating elements, as illustrated in FIG. 1A, were formed from a copper foil tape as the helical antenna. Further, with regard to the conventional antenna, a square-rod-shaped base conductor in which the base conductor of the MSA is downwardly extended, was formed from the copper foil tape. East, West, North, and South directions provided in Table 1 correspond to East, West, North, and South directions provided in FIG. 2B which is a top view of the square MSA 1.

TABLE 1

Example of Measurement of Gain and Axial Ratio of the Antennas when they are directed at an elevation angle of about 10 degrees
Frequency band of 1.6 GHz, and the antennas having a length of about 14 cm

| | Direction | Gain: Horizontally polarized component (dBi) | Gain: Vertically polarized component (dBi) | Axial ratio dB |
|---|---|---|---|---|
| Four-wire helical antenna of the present invention (having a line width of 2.5 mm) | East | −2.78 | −1.48 | 1.30 |
| | West | −3.98 | −1.28 | 2.70 |
| | South | −6.72 | +0.81 | 7.53 |
| | North | −5.47 | −0.29 | 5.18 |
| Downwardly extended base conductor (of the conventional antenna) | East | −6.17 | −1.90 | 4.27 |
| | West | −8.17 | −2.20 | 5.97 |
| | South | −9.77 | −0.61 | 9.16 |
| | North | −8.27 | −1.51 | 6.76 |

Figure 4A:
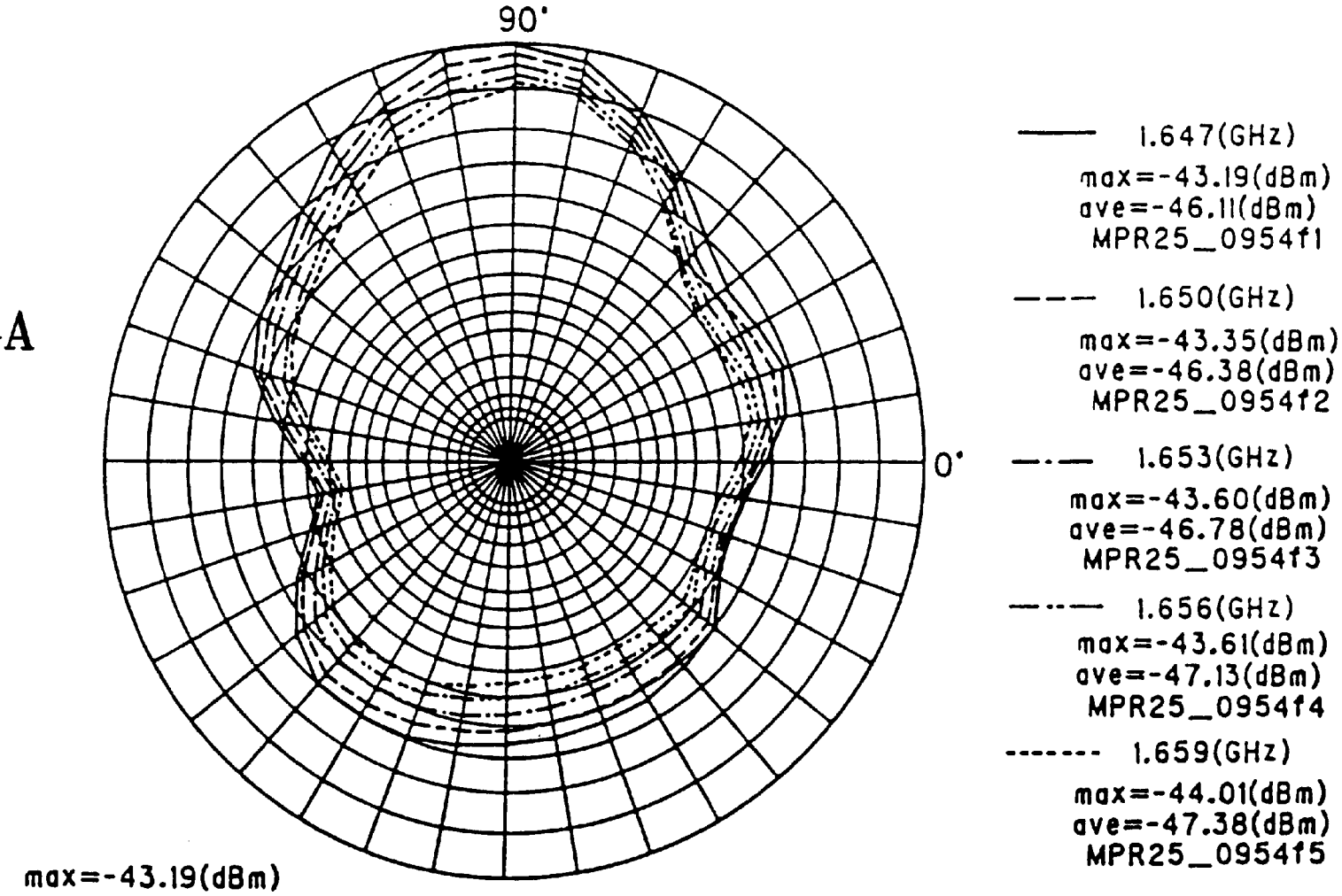
Figure 4B:
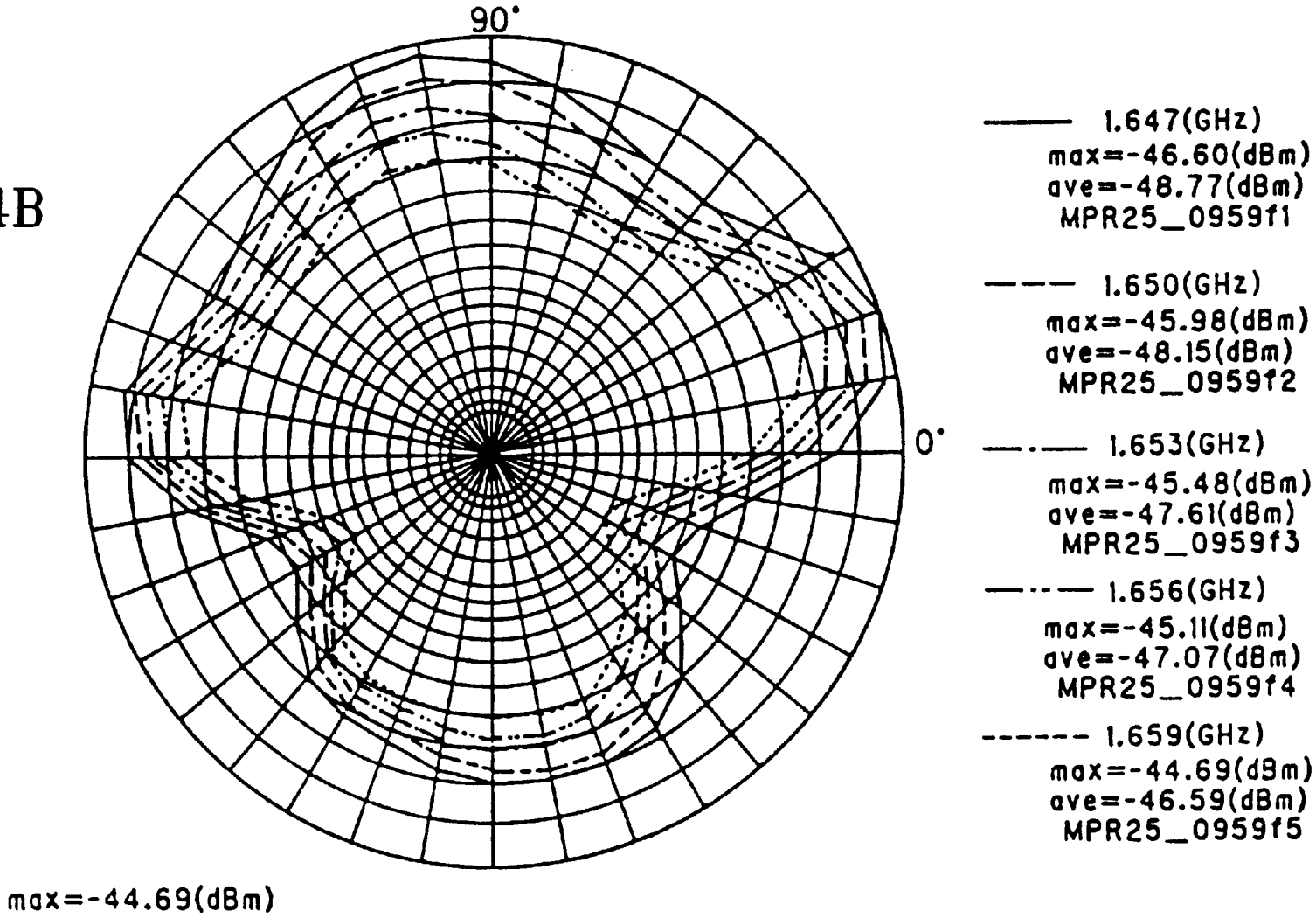
Figure 5A:
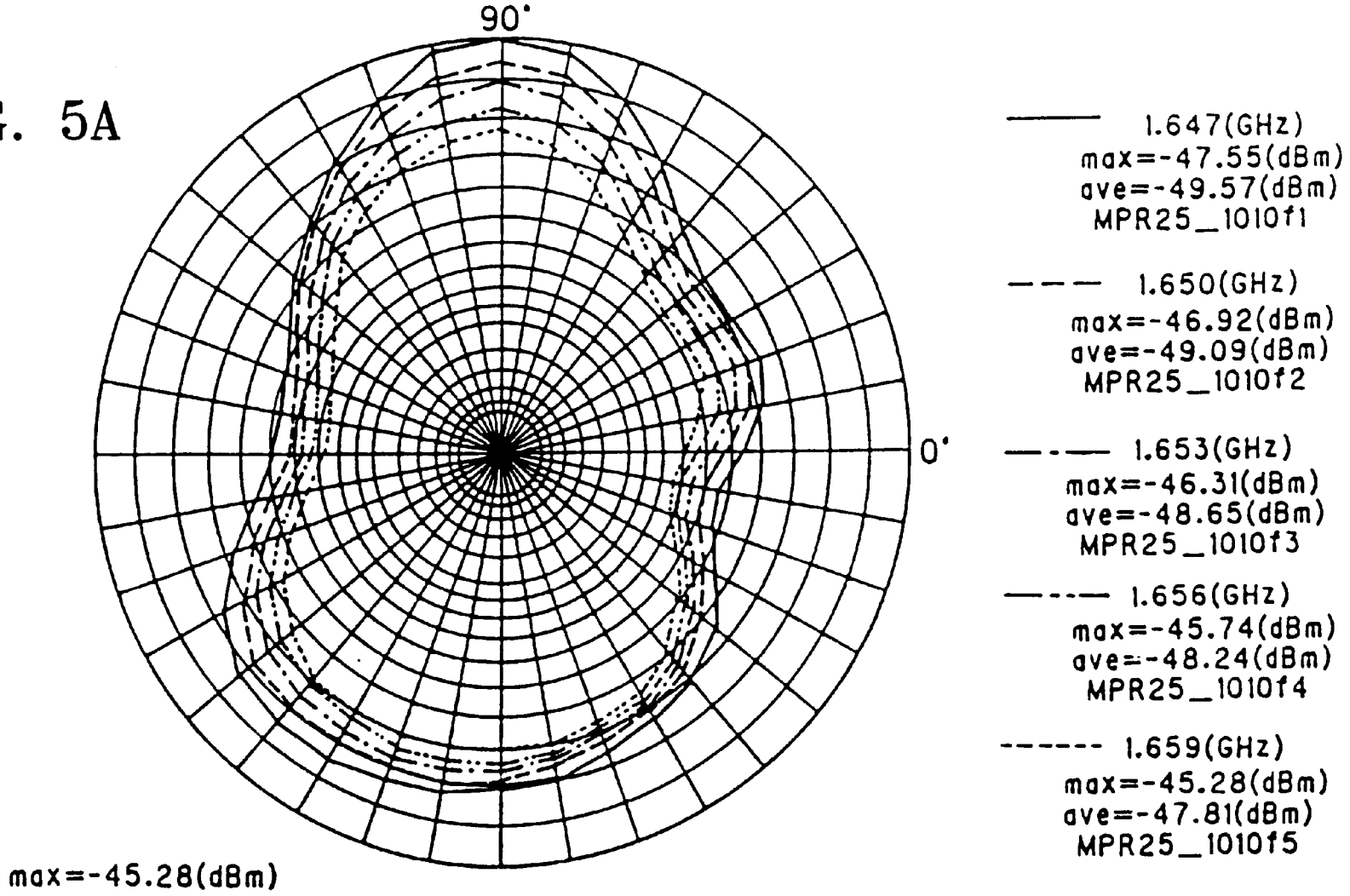
Figure 5B:
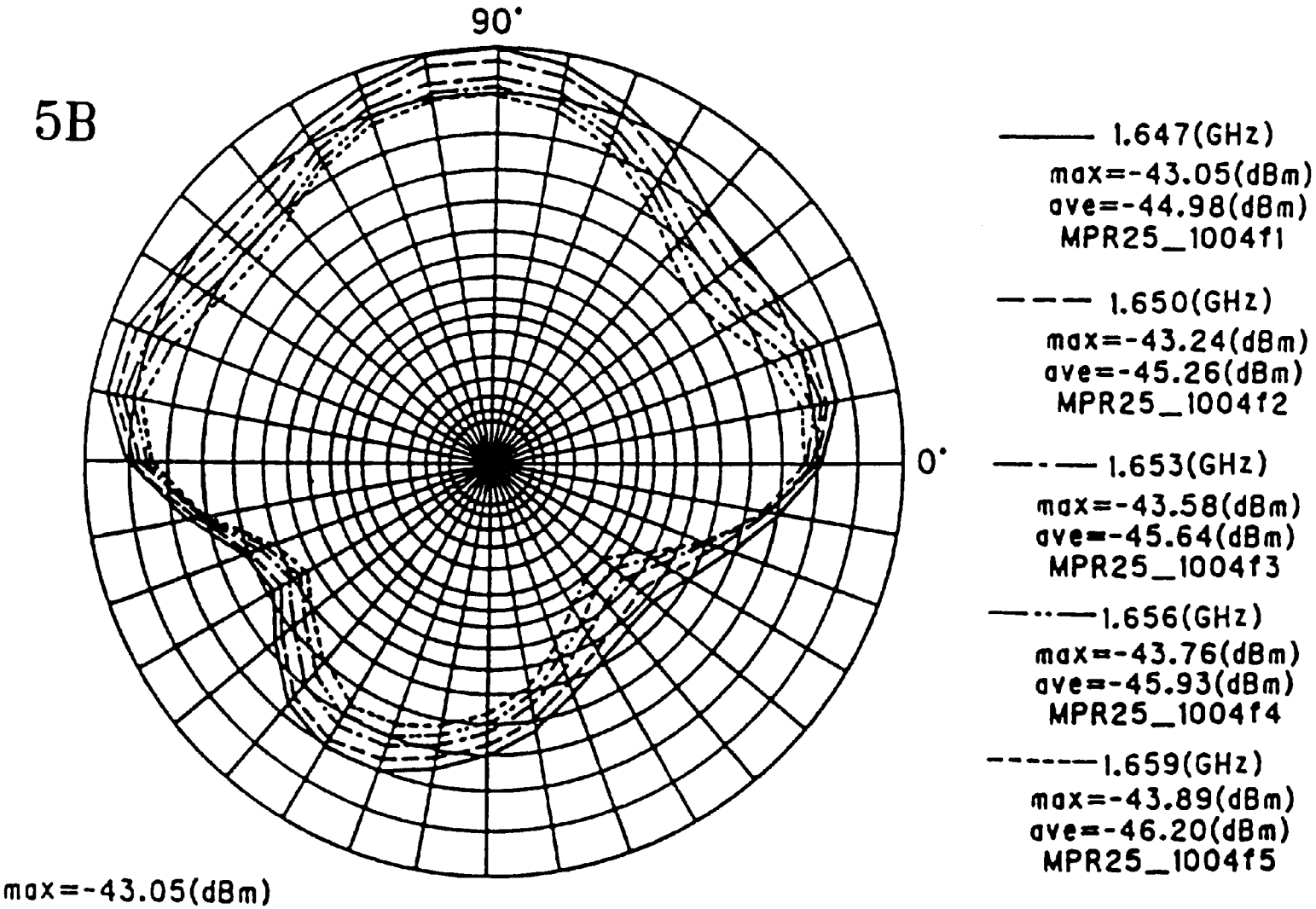

FIGS. 4A and 4B provide examples of measurement of the gain of the composite antenna of the present invention with regard to the linearly polarized wave while the direction of the zenith of the composite antenna is set to 90 degrees. FIG. 4A is a radiation pattern diagram obtained when a longer side of the patched radiating element (or the longer side of the radiating element 1*b* provided in FIG. 2B) is brought in parallel to the direction of the electric field of the linearly polarized antenna (i.e., a transmission antenna). FIG. 4B is a radiation pattern diagram obtained when the longer side of the patched radiating element is brought in parallel to the direction of the magnetic field of the linearly polarized antenna. FIGS. 5A and 5B provide examples of the gain of the composite antenna of the present invention with regard to the linearly polarized wave measured in the same way as in the case illustrated in FIGS. 4A and 4B, while the axis of the composite antenna is further rotated through 90 degrees from the state provided in FIGS. 4A and 4B. FIG. 5A is a radiation pattern diagram obtained when a shorter side of the patched radiating element is brought in parallel to the direction of the electric field of the linearly polarized antenna. FIG. 5B is a radiation pattern diagram obtained when the shorter side of the patched radiating element is brought in parallel to the direction of the magnetic field of the linearly polarized antenna. Each of the antenna measured frequency bands of 1.647 GHz, 1.650 GHz, 1.653 GHz, 1.656 GHz, and 1.659 GHz.

Figure 6:
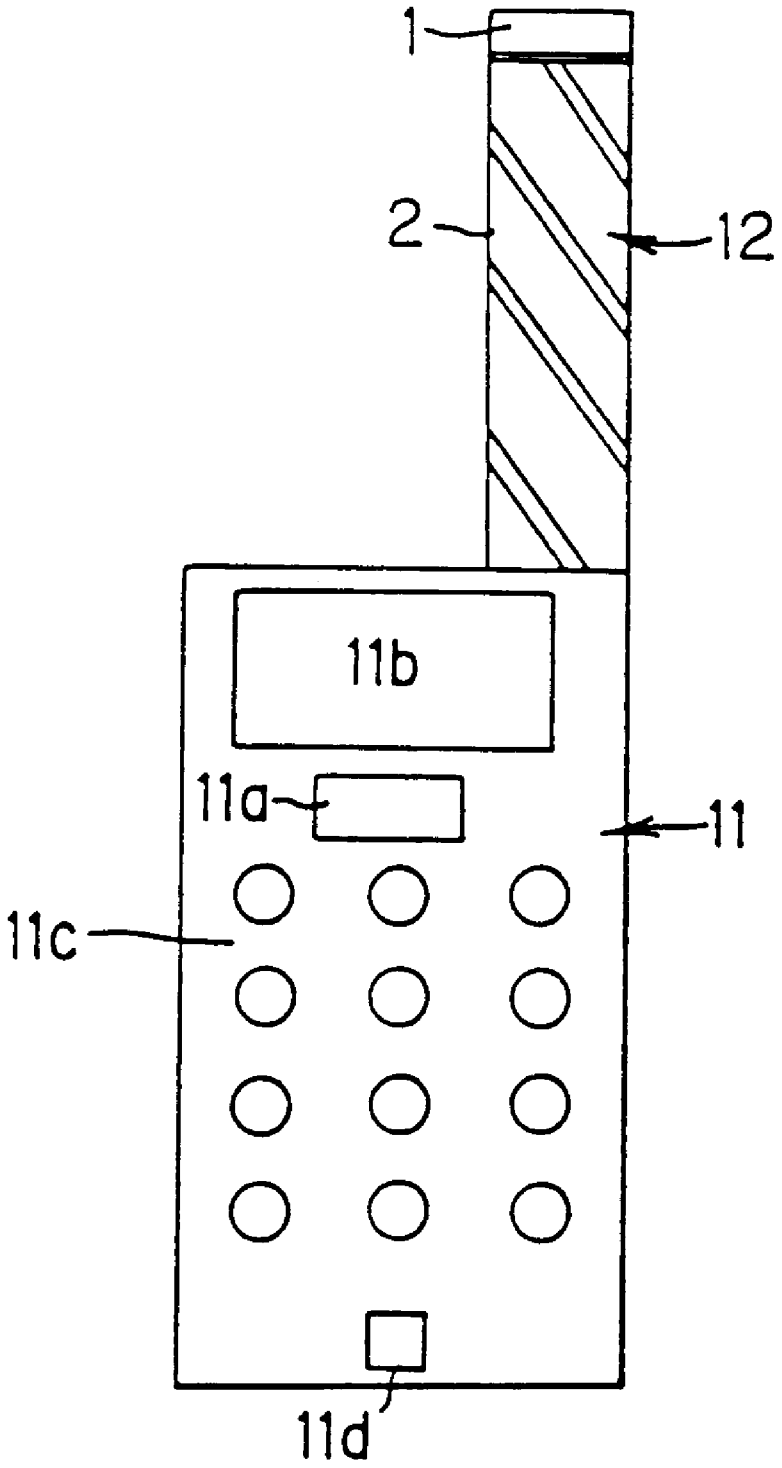
FIG. 6 illustrates a portable radio having a composite antenna of the present invention mounted thereon.
Figure 7:
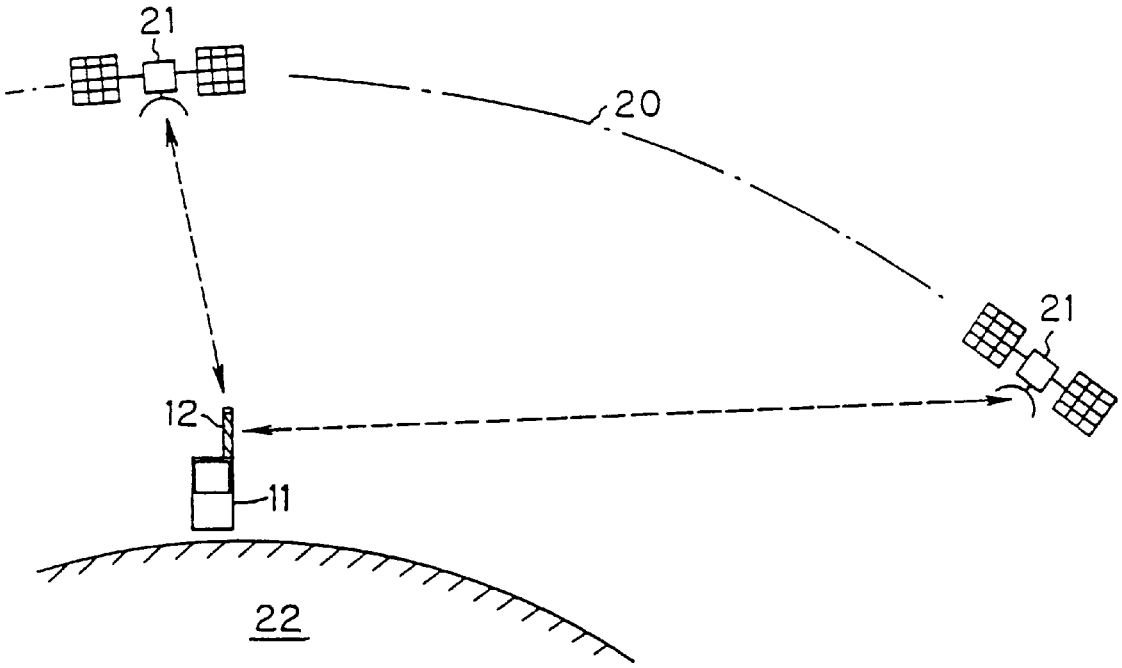
FIG. 7 illustrates a schematic representation of communications established between a satellite and the portable radio having the composite antenna of the present invention mounted thereon.

FIG. 6 illustrates a portable radio having a composite antenna of the present invention mounted thereon. FIG. 7 illustrates a schematic representation of communications established between the portable radio and a satellite. The composite antenna 12 of the present invention provided in FIG. 6 is mounted on the portable radio 11 so as to be practically portable. In this figure, reference numeral 11*a* denotes an ear speaker; 11*b*, a display portion; 11*c*, an operation portion; and 11*d*, a microphone. This display portion 11*b* is located above the ear speaker 11*a*, so that loss of the antenna gain in a direction of a low elevation angle due to a human head is prevented. To mount the composite antenna 12 on the portable radio 11, a dielectric support is provided between the portable radio 11 and the composite antenna 12 so as to support the composite antenna 12 and to permit passage of a transmission line such as a coaxial line 5, whereby the composite antenna 12 is supported at an elevated position so as to be spaced apart from a human body. Further, the composite antenna of the present invention is provided with improved gain and axial radio of the circularly polarized wave at a low elevation angle, which makes it possible to maintain superior communication sensitivity in every direction of the sky. For example, as illustrated in FIG. 7, when communications with respect to the satellite 21 on an orbit 20, the portable radio 11 on the earth is smoothly handed over from the direction of the zenith to the direction of a low elevation angle.

Figure 8:
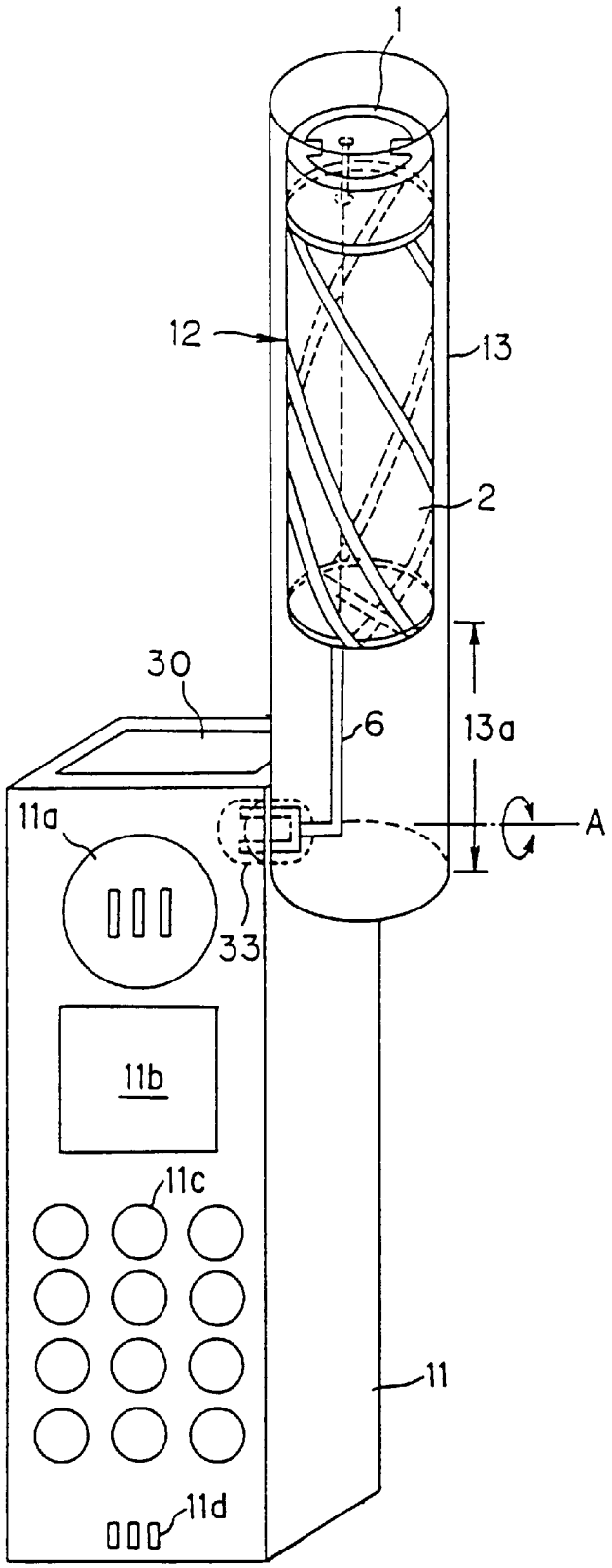
FIG. 8 illustrates another example of the composite antenna of the present invention mounted on a portable radio.
Figure 9:
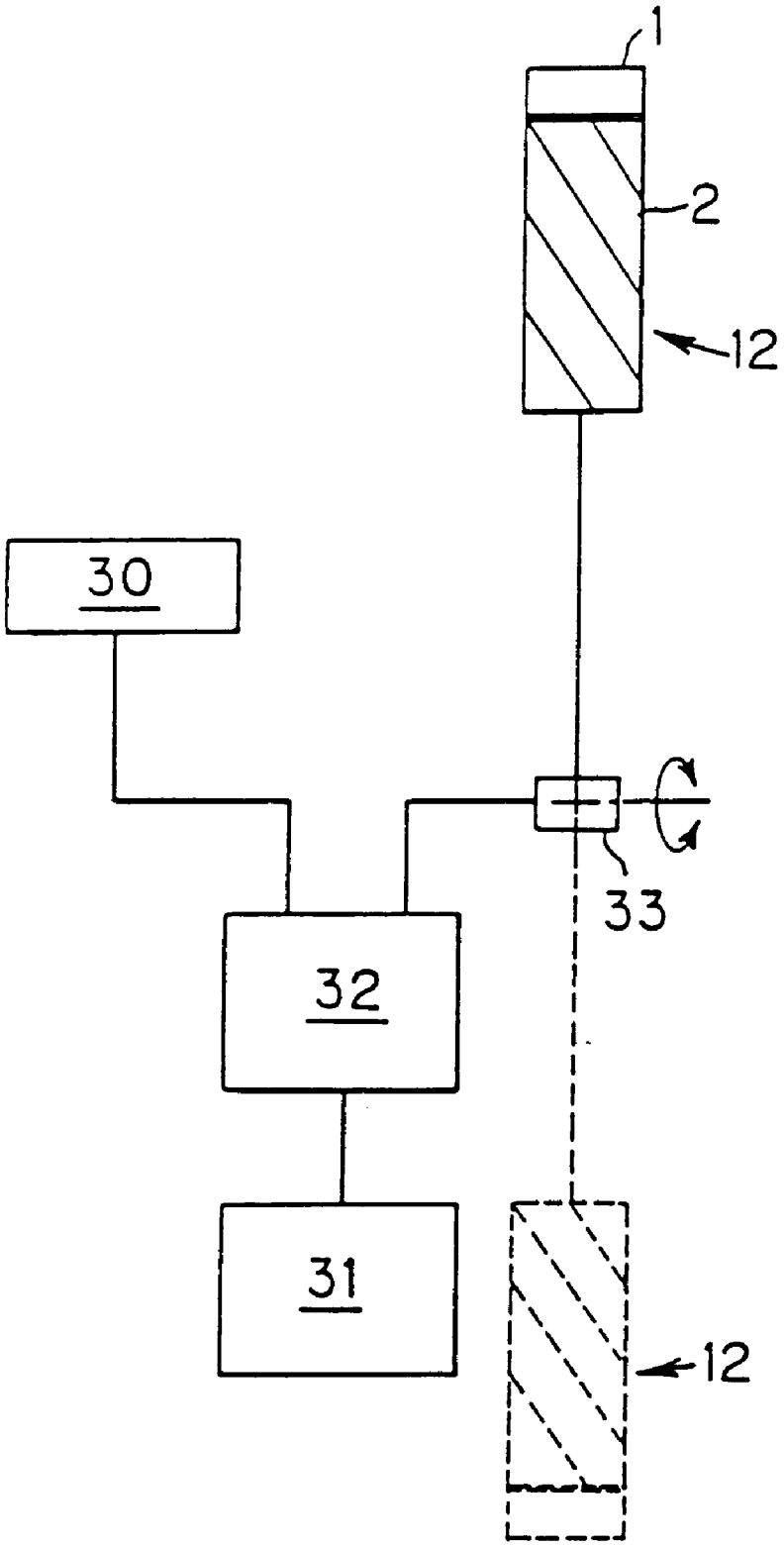
FIG. 9 is a block diagram of the antenna circuit of the portable radio provided in FIG. 8.
Figure 10:
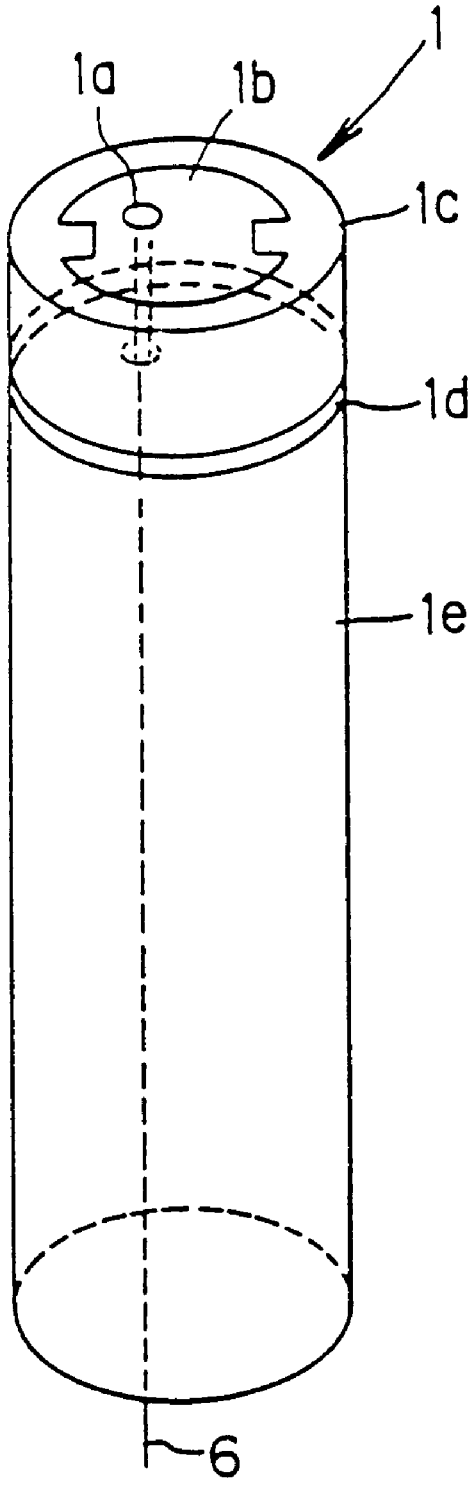
FIG. 10 illustrates an example of a conventional antenna in which the base conductor of a circular MSA is downwardly extended.

FIG. 8 illustrates another example of the composite antenna of the present invention mounted on a portable radio. FIG. 9 is a block diagram of the antenna circuit of the portable radio provided in FIG. 8. The portable radio 11 illustrated in FIG. 8 is configured so as to permit rotation of the composite antenna 12 about the rotational axis A. During a wait mode, the composite antenna 12 is arranged so as to be fitted to a housing of the portable radio 11 in a collapsible manner. A microstrip plane antenna (MSA) 30 is housed so as to be placed on the upper surface of the housing of the portable radio 11, thereby constituting the composite antenna 12 and a diversity antenna. The MSA 30 has a configuration such as that provided in FIGS. 2A and 2B. The MSA 30 has the gain of circularly polarized right-turn (or left-turn) wave mode which is the same as that of the composite antenna 12, chiefly in the direction of the zenith. The diversity antenna is comprised of the composite antenna 12 illustrated in FIG. 9, the MSA 30, a radio section 31, and signal composition means (or signal selection means) 32 of the composite antenna 12 and the MSA 30. As illustrated in FIG. 8, the composite antenna 12 is retained by an antenna retaining cylinder 13 so as to be positioned at an elevated location from the housing of the portable radio 11 by the length of a connection section 13*a*. This is intended to prevent the gain of the antenna in the direction of a low elevation angle from being lost by the head of a human body at the time of communication. To make a call, the composite antenna 12 is held in an upright position, and communications are established using a predetermined circularly polarized right-turn (or left-turn) wave. During a wait mode of the portable radio 11, the composite antenna 12 is rotated so as to be brought into close contact with the side surface of the housing of the portable radio 11. More specifically, the composite antenna 12 rotates around a rotary connector 33 illustrated in FIG. 9 with reference to the housing of the portable radio 11. A broken line in FIG. 9 designates the state of the composite antenna 12 while it is in a collapsed state after rotation. In this collapsed state, the composite antenna 12 is oriented in the direction opposite to the direction in which it is used, thereby reversing the direction of turn of the circularly polarized wave. Therefore, the composite antenna 12 becomes unavailable, and only the MSA 30 becomes active during the wait mode of the portable radio 11.

Although the composite antenna of the portable radio is arranged so as to be collapsible, it may be arranged so as to be withdrawal.

The present invention allows the gain of the antenna and the axial ratio of a circularly polarized wave at a low elevation angle to be improved, as well as easy realization of a composite antenna which maintains communications sensitivity in every direction of the sky. Further, a feeding point is placed at an elevated position, and hence the composite antenna stably operates without being affected by a human body.

What is claimed is:

1. A composite antenna comprising:

a microstrip plane antenna which possesses a circularly polarized wave mode and is made up of a conductive plate serving as a common base conductor, a dielectric layer provided on the conductive plate, and a patched radiating element provided parallel to the conductive plate with the dielectric layer between them;

at least one linear radiating element having a helical shape and disposed in a substantially coaxial relationship with respect to the microstrip plane antenna and is provided below the conductive plate; and the upper ends of the linear radiating element being connected to the conductive plate by DC or capacitive coupling, thereby forming a helical antenna.

2. The composite antenna as defined in claim 1, wherein a common feeding point is provided in the vicinity of a through-hole formed in the conductive plate, and power is fed to the microstrip plane antenna from the back of the patched radiating element through a feeding pin which upwardly extends from the feeding point, as well as to the helical antenna from the linear radiating element through the conductive plate.

3. The composite antenna as defined in claim 1, wherein the helical antenna is formed from a plurality of linear radiating elements, and the linear radiating elements cross one another at an intersection without a contact at the lower bottom end of the helical antenna.

4. The composite antenna as defined in claim 1, further comprising at least one directivity-controlling radiating element for controlling the directivity of the antenna, the directivity-controlling radiating element being connected to the at least one linear radiating element, without a direct contact between them, by DC or capacitive coupling.

5. A composite antenna comprising:

a conductive plate;

a patched radiating element disposed above the conductive plate and parallel thereto;

a dielectric layer disposed between the conductive plate and the patched radiating element; and at least one linear radiating element disposed below the conductive plate and having a helical shape defined around an axis which is substantially perpendicular to the conductive plate, one end of the linear radiating element being connected to the conductive plate by DC or capacitive coupling.

* * * * *